US007484258B2

(12) United States Patent
Kim et al.

(10) Patent No.: US 7,484,258 B2
(45) Date of Patent: Feb. 3, 2009

(54) METHOD AND APPARATUS FOR DETECTING LAUNDRY WEIGHT OF WASHING MACHINE

(75) Inventors: Tae-Kyoung Kim, Seoul (KR); Soon-Bae Yang, Seoul (KR); Kwan-Yuhl Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 688 days.

(21) Appl. No.: 10/896,078

(22) Filed: Jul. 22, 2004

(65) Prior Publication Data

US 2005/0015890 A1 Jan. 27, 2005

(30) Foreign Application Priority Data

Jul. 23, 2003 (KR) ..... 10-2003-0050727

(51) Int. Cl.
*D06F 35/00* (2006.01)

(52) U.S. Cl. ..... 8/158; 8/159; 68/24; 68/12.04; 68/12.06; 68/12.16

(58) Field of Classification Search ..... 68/24, 68/12.04, 12.06, 12.16; 8/159, 158
See application file for complete search history.

(56) References Cited

U.S. PATENT DOCUMENTS

| | | | | |
|---|---|---|---|---|
| 5,057,759 | A * | 10/1991 | Ueda et al. | 318/616 |
| 6,023,854 | A * | 2/2000 | Tsunomoto et al. | 34/531 |
| 6,029,300 | A * | 2/2000 | Kawaguchi et al. | 8/159 |
| 6,163,912 | A | 12/2000 | Matsuura et al. | |
| 6,202,791 | B1 | 3/2001 | Oh et al. | |
| 6,374,444 | B2 | 4/2002 | Skrippek et al. | |
| 6,505,369 | B1 | 1/2003 | Weinmann | |
| 6,612,138 | B2 | 9/2003 | Ryu et al. | |
| 6,615,619 | B2 | 9/2003 | Kakuda et al. | |
| 2004/0196902 | A1 * | 10/2004 | Faroudja | 375/240.1 |
| 2006/0021392 | A1 | 2/2006 | Hosoito et al. | |

FOREIGN PATENT DOCUMENTS

| | | |
|---|---|---|
| CN | 1333398 | 1/2002 |
| CN | 1685101 | 10/2005 |
| DE | 19832292 | 1/2000 |
| DE | 19928657 | 12/2000 |
| GB | 2266932 | 11/1993 |
| JP | 64-15095 | 1/1989 |
| JP | 9253379 | 9/1997 |
| JP | 2000-51579 | 2/2000 |
| JP | 2000-140481 | 5/2000 |
| JP | 2002-360970 | 12/2002 |

OTHER PUBLICATIONS

U.S. Appl. No. 10/833,134 to Si Moon Jeon et al., filed Apr. 28, 2004.

(Continued)

*Primary Examiner*—Frankie L Stinson
*Assistant Examiner*—Samuel A Waldbaum
(74) *Attorney, Agent, or Firm*—Greenblum & Bernstein, P.L.C.

(57) ABSTRACT

A method and an apparatus for detecting a laundry weight of a washing machine can correctly detect a laundry weight of a washing machine. To this end, a motor of a washing machine is driven at a first speed and then at a second speed, and a laundry weight is detected on the basis of a value of a first current for driving the motor at the first speed and a value of a second current for driving the motor at the second speed.

11 Claims, 7 Drawing Sheets

OTHER PUBLICATIONS

English Language Abstract of JP 2002-360970.
English Language Abstract of JP 2000-140481.
English Language Abstract of CA 1333398.
English Language abstract of JP-9-253379.
English language Abstract of CN 1685101.
English language Abstract of JP 2000-51579.
English language Abstract of JP 64-15095.

* cited by examiner

FIG. 7

COMPARISON OF WEIGHT OF DRY LAUNDRY WITH WEIGHT OF WET LAUNDRY

| | DRY LAUNDRY | | | | | | WET LAUNDRY | |
|---|---|---|---|---|---|---|---|---|
| | [kg] | FIRST TIME | SECOND TIME | THIRD TIME | FOURTH TIME | FIFTH TIME | [kg] | WET LAUNDRY/ DRY LAUNDRY |
| IEC | 7 | 22630 | 22670 | 22645 | 22665 | 22659 | 22.654 | 3.24 |
| | 6 | 19961 | 20122 | 20284 | 19710 | 20181 | 20.052 | 3.34 |
| | 5 | 16591 | 16528 | 16915 | 16121 | 16273 | 16.486 | 3.30 |
| | 4 | 13219 | 13892 | 13646 | 13590 | 13885 | 13.646 | 3.41 |
| | 3.5 | 11547 | 11574 | 11594 | 11511 | 11576 | 11.560 | 3.30 |
| | 3 | 9889 | 10007 | 10034 | 9860 | 9980 | 9.954 | 3.32 |
| | 2 | 6955 | 6796 | 6974 | 6954 | 7099 | 6.956 | 3.48 |

| | DRY LAUNDRY | | | | | | WET LAUNDRY | |
|---|---|---|---|---|---|---|---|---|
| | [kg] | FIRST TIME | SECOND TIME | THIRD TIME | FOURTH TIME | FIFTH TIME | [kg] | WET LAUNDRY/ DRY LAUNDRY |
| KS | 3.5 | 15584 | 15192 | 15324 | 15356 | 15278 | 15.347 | 4.38 |
| | 3 | 13319 | 12917 | 13070 | 13185 | 13059 | 13.110 | 4.37 |
| | 2 | 9201 | 9278 | 9318 | 9083 | 9307 | 9.237 | 4.62 |
| | 1 | 4573 | 4752 | 4654 | 4663 | 4635 | 4.655 | 4.66 |

| | DRY LAUNDRY | | | | | | WET LAUNDRY | |
|---|---|---|---|---|---|---|---|---|
| | [kg] | FIRST TIME | SECOND TIME | THIRD TIME | FOURTH TIME | FIFTH TIME | [kg] | WET LAUNDRY/ DRY LAUNDRY |
| Quelle | 2 | 10636 | 10733 | 10508 | 10744 | 10892 | 10.703 | 5.35 |
| | 1 | 5765 | 5730 | 5714 | 5707 | 5700 | 5.723 | 5.72 |

METHOD AND APPARATUS FOR DETECTING LAUNDRY WEIGHT OF WASHING MACHINE

BACKGROUND OF THE INVENTION

1. Field of the Invention

The present invention relates to a washing machine, and particularly, to a method and an apparatus for detecting a laundry weight of a washing machine.

2. Description of the Background Art

In general, a washing machine is a device for washing laundry by performing a washing process, a rinsing process and a dewatering process. The washing machine is classified into a pulsator type, an agitation type, a drum type or the like according to washing methods. Also, the washing machine measures the laundry weight and the amount of eccentricity, and the laundry weight is an important factor to determine a dewatering speed.

FIG. 1 is a view showing a waveform for determining a laundry weight value by using a method of detecting the laundry weight of a washing machine in accordance with the conventional art.

As shown therein, in a method for detecting a laundry weight of a washing machine in accordance with the conventional art, a motor is driven twice at the same speed for the same time, and then a laundry weight of a washing machine is calculated based on an average value of a current needed to drive the motor, an average value of the amount of eccentricity according to a variation of a motor speed and a supply voltage compensation value. Here, the average value of the current is an average value of a current applied to the motor while the motor is driven at the same speed.

In addition, the amount of eccentricity is measured by using the size of a speed ripple, which has detected through a speed sensor. Namely, a speed data ($v_k$) is measured every certain angle (e.g., an angle of 30°), and an acceleration data ($a_k$) is obtained by subtracting the sum total of first six speed data ($v_{k-6}+v_{k-7}+v_{k-8}+v_{k-9}+v_{k-10}+v_{k-11}$) which have previously measured from the sum total of another six speed data ($v_k+v_{k-1}+v_{k-2}+v_{k-3}+v_{k-4}+v_{k-5}$). Here, when twelve acceleration data each of which is obtained when a drum of a washing machine rotates once are obtained, a minimum value of the data is subtracted from their maximum value, thereby obtaining the amount of eccentricity. The amount of eccentricity can be denoted as the following Equation 1 and 2.

$$a_k=(v_k+v_{k-1}+v_{k-2}+v_{k-3}+v_{k-4}+v_{k-5})-(v_{k-6}+v_{k-7}+\ldots v_{k-11}) \quad \text{Equation 1}$$

$$\text{Amount of eccentricity}=\max(a_1,a_2,\ldots a_{12})-\min(a_1,a_2,\ldots a_{12}) \quad \text{Equation 2}$$

Accordingly, a final laundry weight of a washing machine is obtained by the following Equation 3 based on an average value of a first laundry weight and a second laundry weight, first amount of eccentricity and second amount of eccentricity, and a supply voltage compensation value.

$$\text{Final laundry weight value}=(\text{first laundry weight}+\text{second laundry weight})/2+\text{supply power compensation value}-(\text{first amount of eccentricity}+\text{second amount of eccentricity})+k_1 \quad \text{Equation 3}$$

Here, the first laundry weight is an average value of a current for first 'a' seconds, and the second laundry weight is an average value of a current for second 'a' seconds. The first amount of eccentricity is the average amount of eccentricity for first 'a' seconds, and the second amount of eccentricity is the average amount of eccentricity for second 'a' seconds. In addition, the supply voltage compensation value=(detected supply voltage value−$k_2$)*$k_3$, the eccentricity compensation value=(first eccentricity+second eccentricity)/2}*$k_4$, and $k_1$~$k_4$ are scale values set arbitrarily in order to determine the laundry weight.

Hereinafter, laundry weight values by laundry, which are measured by using a method for detecting the laundry weight in accordance with a different conventional art will now be described with reference to FIG. 2.

FIG. 2 is a view showing laundry weight values by laundry, which are measured by a method for detecting a laundry weight in accordance with the different conventional art.

As shown therein, in the method for detecting the laundry weight of a washing machine in accordance with the different conventional art, the laundry weight of the washing machine is calculated by using an average value of a current applied to a motor of the washing machine, an average value of the amount of eccentricity and a compensation value of a supply voltage. Here, in order to obtain the amount of eccentricity generated when the washing machine dewaters the laundry, speed data are measured every certain electrical angle, and an acceleration is obtained by using the sum total of the speed data and the sum total of previous speed data. Then, based on a maximum value and a minimum value of the acceleration data, the amount of eccentricity is calculated. However, the method has a problem in that a motor of a washing machine employing an correctly-designed current/speed control system has a small speed variation, which causes incorrect measuring of the amount of eccentricity.

In addition, when the laundry weight is detected by using a compensation value of a supply voltage, if a supply voltage is not constantly supplied, a different supply voltage value is compensated for the same load. Accordingly, it is difficult to obtain a correct laundry weight.

In addition, the method for detecting the laundry weight in accordance with the conventional art has a problem in that a weight of wet laundry cannot be correctly detected because a laundry weight is obtained based on dry laundry.

Detailed description on washing machine in accordance with conventional arts is disclosed in U.S. Pat. No. 6,615,619 and No. 6,612,138.

SUMMARY OF THE INVENTION

Therefore, an object of the present invention is to provide a method and an apparatus for detecting a laundry weight of a washing machine capable of driving a motor of a washing machine at a first speed and then at a second speed and correctly detecting a laundry weight based on current values for driving the motor at the first speed and at the second speed.

To achieve these and other advantages and in accordance with the purpose of the present invention, as embodied and broadly described herein, there is provided a method for detecting a laundry weight of a washing machine comprising: driving a motor of a washing machine at a first speed and then driving the motor at a second speed; and detecting a laundry weight of the washing machine on the basis of a first current value for driving the motor at the first speed and a second current value for driving the motor at the second speed, wherein the second speed is higher than the first speed.

To achieve these and other advantages and in accordance with the purpose of the present invention, as embodied and broadly described herein, there is provided a method for detecting a laundry weight of a washing machine comprises: converting a mode of a washing machine into a dewatering mode, driving a motor of the washing machine sequentially at a first speed and at a second speed for a preset time and then detecting a current for driving the motor at the first speed and a current for driving the motor at the second speed, respectively; outputting a first current by filtering each detected current through a first low pass filter; outputting a second current by filtering each detected current through a second low pass filter; calculating a maximum value and a minimum value of an eccentricity current to be used to calculate a compensation value of the amount of eccentricity of the drum of the washing machine on the basis of values of the first current and the second current; calculating a maximum value and a minimum value of a laundry weight current to be used to calculate a laundry weight value prior to compensation of the amount of the eccentricity on the basis of the first current; calculating a first current amplitude on the basis of a maximum value and a minimum value of the eccentricity current and calculating a second current amplitude on the basis of a maximum value and a minimum value of the laundry weight current; and detecting a final laundry weight on the basis of a predetermined compensation value of the amount of eccentricity, which corresponds to the first current amplitude and a predetermined laundry weight value corresponding to the second current amplitude.

To achieve these and other advantages and in accordance with the purpose of the present invention, as embodied and broadly described herein, there is provided an apparatus for detecting a laundry weight of a washing machine comprising: a detector for detecting a current value for driving a motor at a first speed and a current value for driving the motor at a second speed when a mode of the washing machine is converted into a dewatering mode and the motor of the washing machine is driven sequentially at the first speed and at the second speed for a preset time; a first low pass filter having a high cut-off frequency for filtering each detected current value and outputting a first current value; a second low pass filter having a low cut-off frequency for filtering each detected current value and outputting a second current value; a controller for calculating a maximum value and a minimum value of an eccentricity current to be used to calculate a compensation value of the amount of eccentricity of a drum of the washing machine on the basis of a value obtained by adding the first current value to the second current value and calculating a maximum value and a minimum value of a laundry weight current to be used to calculate a laundry weight value prior to compensation of the amount of eccentricity on the basis of the first current value; a storage for storing the maximum value and the minimum value of the eccentricity current and the maximum value and the minimum value of the laundry weight current; and a laundry weight detector for calculating a first current amplitude on the basis of the stored maximum and minimum values of the eccentricity current, calculating a second current amplitude on the basis of the stored maximum and minimum values of the laundry weight current, detecting a predetermined compensation value of the amount of eccentricity, which corresponds to the first current amplitude from the storage, detecting a predetermined laundry weight value corresponding to the second current amplitude from the storage and detecting a final laundry weight on the basis of the detected compensation value of the amount of eccentricity and the detected laundry weight value.

To achieve these and other advantages and in accordance with the purpose of the present invention, as embodied and broadly described herein, there is provided an apparatus for detecting a laundry weight of a washing machine comprises: a controller for driving a motor of a washing machine at a first speed and then driving the motor at a second speed; and a laundry weight detector for detecting a laundry weight on the basis of a value of the first current for driving the motor at the first speed and a value of the second current for driving the motor at the second speed, wherein the second speed is higher than the first speed.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings:

FIG. 7 is a view for comparing a weight of wet laundry with a weight of dry laundry.

DETAILED DESCRIPTION OF THE PREFERRED EMBODIMENTS

The preferred embodiment of a method and an apparatus for detecting a laundry weight of a washing machine capable of driving a motor of a washing machine sequentially at first and second speeds and correctly detecting a laundry weight based on amplitudes of a current for driving the motor at the first speed and a current for driving the motor at the second speed, will now be described with reference to FIGS. 3~8D.

Figure 1:
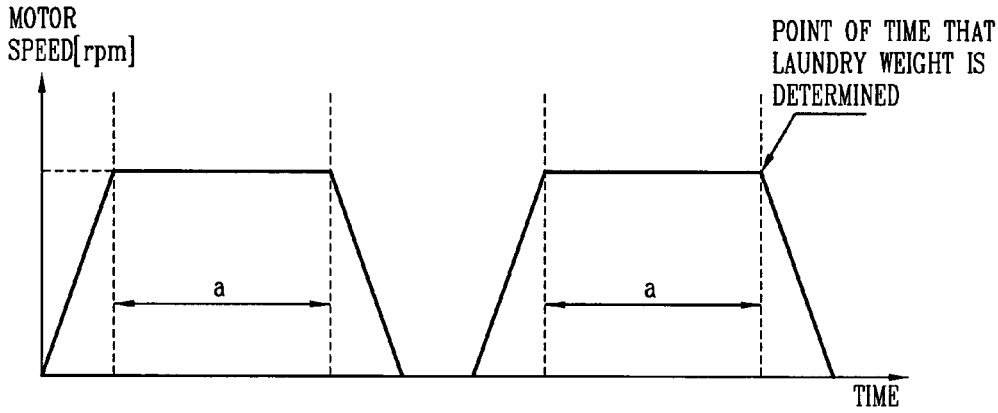
FIG. 1 BACKGROUND ART
FIG. 1 is a view showing a waveform for determining a laundry weight value by a method for detecting a laundry weight of a washing machine in accordance with the conventional art.
Figure 2:
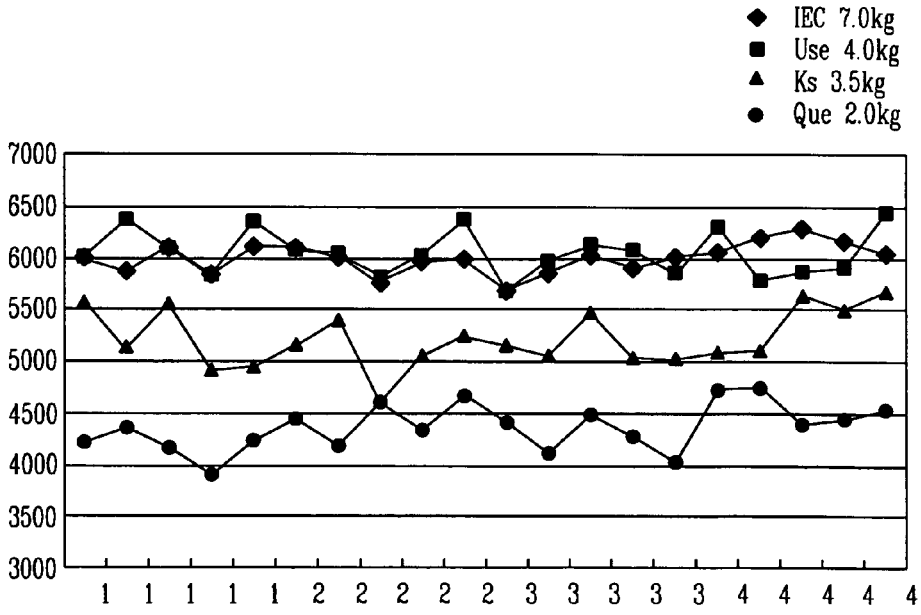
FIG. 2 BACKGROUND ART
FIG. 2 is a view showing laundry weight values by laundry, which are measured by a method for detecting a laundry weight in accordance with the different conventional art.
Figure 3:
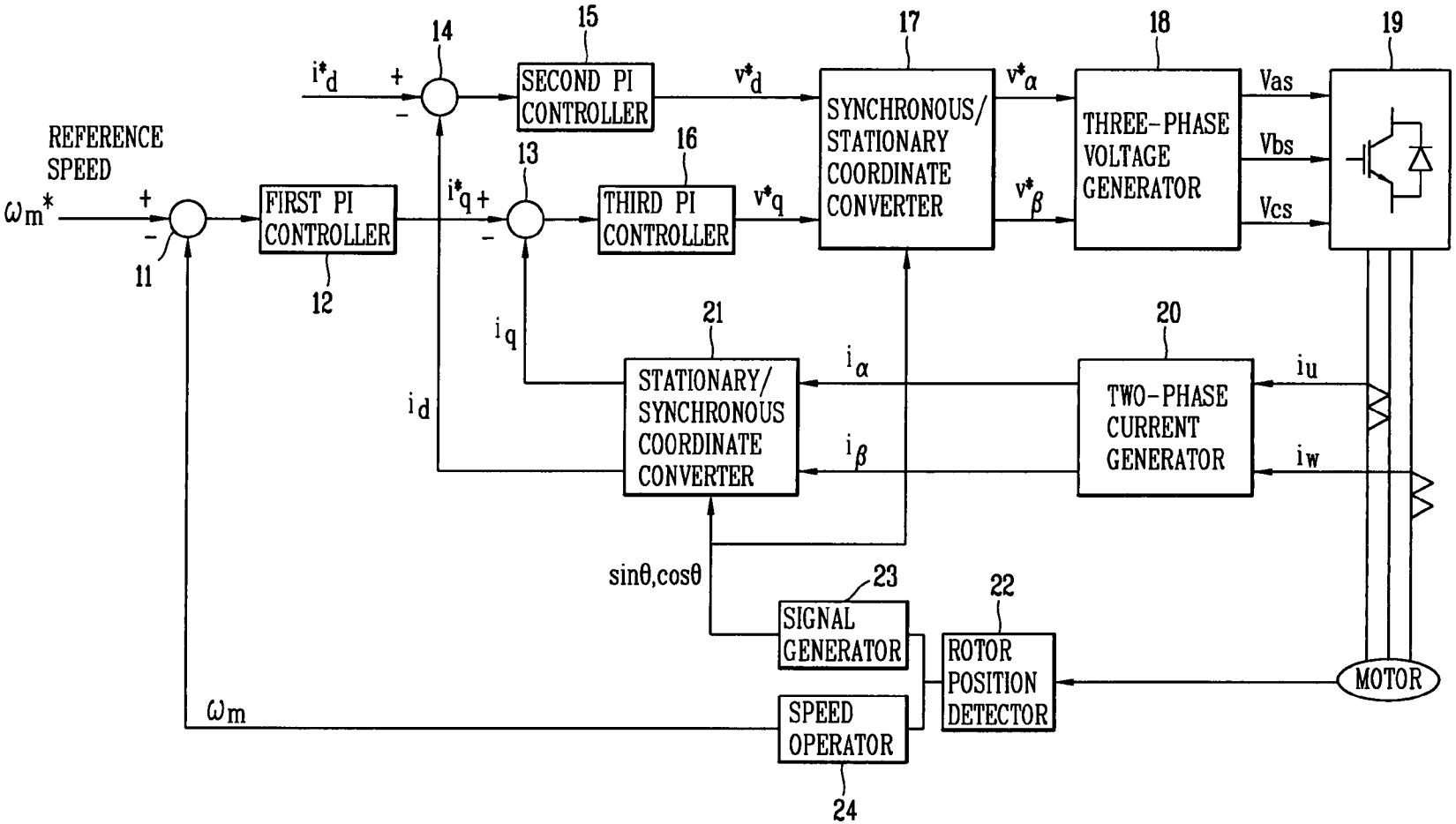
FIG. 3 is a block diagram showing a structure of a speed control apparatus of a motor of a washing machine, for describing a method for detecting a laundry weight of a washing machine in accordance with the present invention.

FIG. 3 is a block diagram showing a structure of a speed control apparatus of a motor of a washing machine, for describing a method for detecting a laundry weight of a washing machine in accordance with the present invention.

As shown therein, the speed control apparatus of a motor includes: a comparer 11 for comparing an estimated current speed ($\omega_m$) with a reference speed ($\omega_m$*); a first proportional integration (PI) controller 12 for outputting a reference torque component current ($i_q$*) for compensating a speed error value obtained by comparing the estimated current speed ($\omega_m$) with the reference speed ($\omega_m$*); a second proportional Integration (PI) controller 15 for outputting a reference magnetic flux component current for compensating an error value obtained by comparing a real magnetic flux component current ($i_d$) with the reference magnetic flux component current ($i_d$*) as a reference magnetic flux component voltage ($v_d$*); a third PI controller 16 for outputting a reference torque component current for compensating an error value obtained by comparing the real torque component current ($i_q$) with the reference torque component current ($i_q$*) as a reference torque component voltage ($v_q$*); a synchronous/stationary coordinate converter 17 for converting the reference magnetic flux component voltage ($v_d$*) and the reference torque component voltage ($v_q$*) from a synchronous coordinate system to a stationary coordinate system according to sine and cosine values (sin θ and cos θ) in a real magnetic flux angle θ; a three phase voltage generator 18 for converting the reference magnetic flux component voltage ($v_d$*) and the reference torque component voltage ($v_q$*) in the stationary coordinate system into three phase voltage (Vas, Vbs, Vcs) and outputting the converted three phase voltage (Vas, Vbs, Vcs); an inverter 19 for applying the three phase voltage (Vas, Vbs, Vcs) generated from the three phase voltage generator 18 to the motor; a rotor position detector 22 for detecting a position of a rotor of the motor; a speed calculator 24 for outputting the estimated current speed ($\omega_m$) from the detected position of the rotor; a signal generator 23 for generating the sine and cosine values (sin θ and cos θ) of the real magnetic flux angle (θ) from the detected position of the rotor and outputting the sine and cosine values (sin θ and cos θ); a two phase current generator 20 for converting the three phase current detected when the motor is driven into two phase current ($i_\alpha$,$i_\beta$) and outputting the two phase current ($i_\alpha$,$i_\beta$); and a stationary/synchronous coordinate converter 21 for converting the two phase current ($i_\alpha$,$i_\beta$) into a rotating coordinate system and outputting the real torque component current ($i_q$) and the real magnetic flux component current ($i_q$). Here, a third comparer 13 of FIG. 3 compares the real torque component current ($i_q$) outputted from the stationary/synchronous coordinate converter 21 with the reference torque component current ($i_q$*) outputted from the first PI controller 12. In addition, a second comparer 12 of FIG. 3 compares the real magnetic flux component current ($i_d$) with the reference magnetic flux component current ($i_d$*) and outputs an error value according to the comparison result.

Because the speed control apparatus of the motor is the same as the conventional art, descriptions on the same structure will be omitted. Hereinafter, a method for detecting a laundry weight of a washing machine based on a real torque component current ($i_q$) of the speed control apparatus of the motor, will now be described in detail with reference to FIG. 4. That is, a fact that a laundry weight of a load and the amount of eccentricity are revealed by a variation of a real torque component current ($i_q$) when a motor of a washing machine is rotated at a constant speed by being controlled was found out by several trials and errors. Here, the speed control apparatus of the motor may be varied in various forms, and a laundry weight is detected based on a current applied to the motor in a method for detecting a laundry weight of a washing machine in accordance with the present invention.

Figure 4:
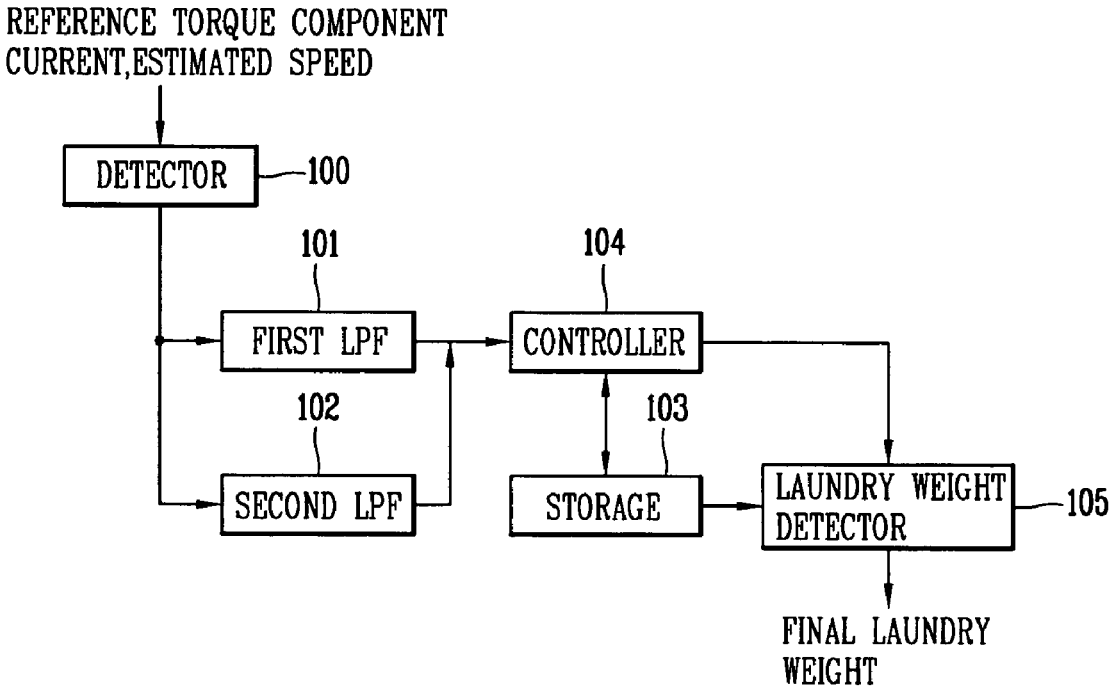
FIG. 4 is a construction view showing an apparatus for detecting a laundry weight of a washing machine in accordance with the present invention.

FIG. 4 is a construction view showing an apparatus for detecting a laundry weight of a washing machine in accordance with the present invention.

As shown therein, the apparatus for detecting a laundry weight of a washing machine in accordance with the present invention includes: a detector 100 for detecting a real torque component current ($i_q$) for driving a motor at a first speed and a real torque component current ($i_q$) for driving the motor at a second speed when a mode of the washing machine is converted into a dewatering mode and the motor of the washing machine is driven sequentially at the first speed and at the second speed for a predetermined time; a first low pass filter (LPF) 101 having a high cut-off frequency for filtering each detected real torque component current and outputting a first real torque component current (first current); a second LPF 102 having a low cut-off frequency for filtering each detected real torque component current and outputting a second real torque component current (second current); a controller 104 for calculating a maximum value and a minimum value of a current (referred to as eccentricity current) to be used to calculate a compensation value of the amount of eccentricity of the drum on the basis of the first current and the second current and calculating a maximum value and a minimum value of a current (referred to as laundry weight current) to be used to calculate a laundry weight value prior to compensation of the amount of eccentricity on the basis of the first current; a storage 103 for storing the maximum value and the minimum value of the eccentricity current and the maximum value and the minimum value of the laundry weight current; and a laundry weight detector 105 for calculating a first current amplitude (referred to as eccentricity current amplitude) on the basis of the stored maximum value and the minimum value of the eccentricity current, calculating a second current amplitude (referred to as laundry weight current amplitude) on the basis of the stored maximum value and the minimum value of the laundry weight current, detecting a predetermined compensation value of the amount of eccentricity, which corresponds to the first current amplitude from the storage 103, detecting a predetermined laundry weight value corresponding to the second current amplitude from the storage 103 and detecting a final laundry weight on the basis of the detected laundry weight value and the detected compensation value of the amount of eccentricity.

Hereinafter, an operation of an apparatus for detecting a laundry weight of a washing machine in accordance with the present invention will now be described in detail with reference to FIG. 5.

Figure 5:
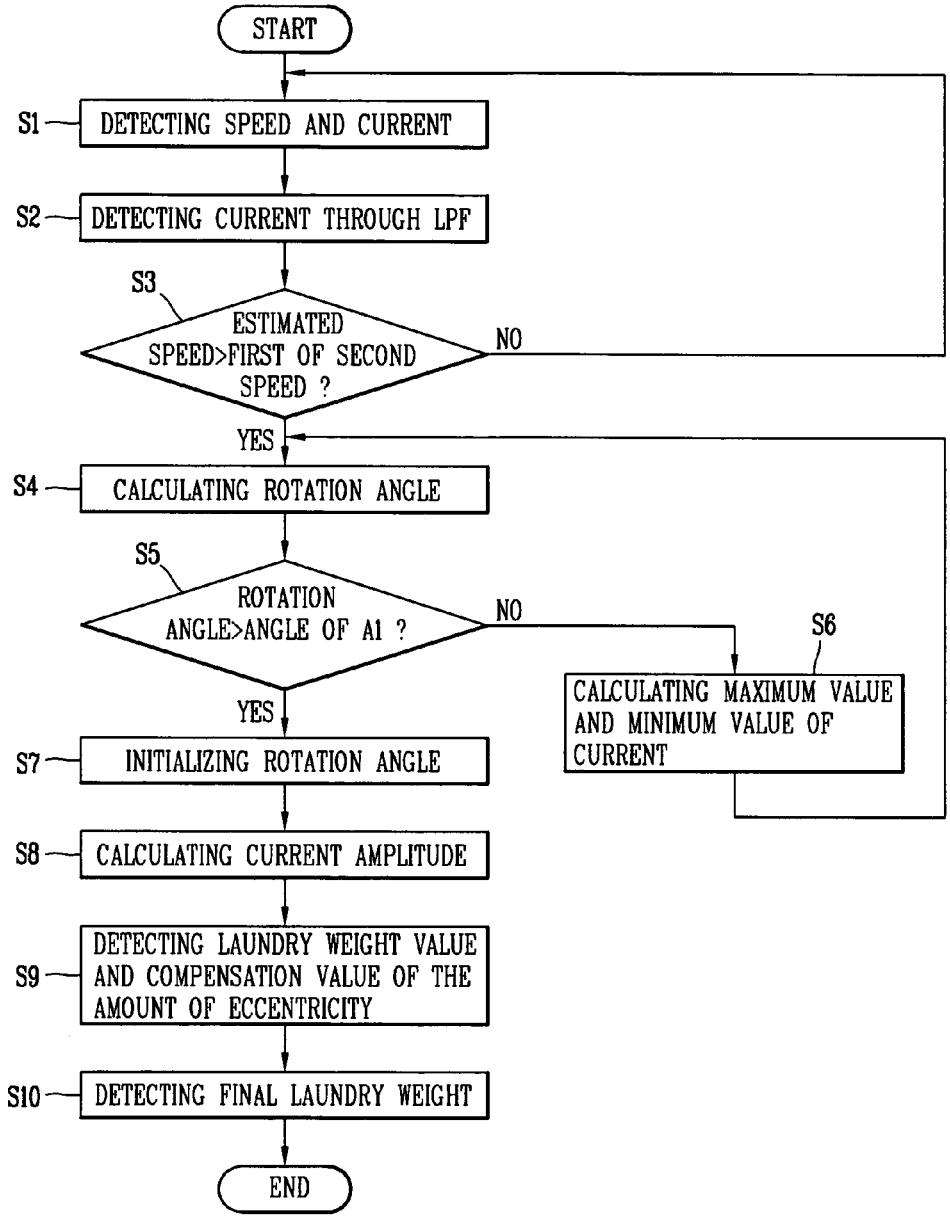
FIG. 5 is a flow chart showing a method for detecting a laundry weight of a washing machine in accordance with the present invention.

FIG. 5 is a flow chart showing a method for detecting the laundry weight of the washing machine in accordance with the present invention.

First, when a washing mode of the washing machine is converted into a dewatering mode after being completed, and a motor of the washing machine is driven sequentially at a first speed for a predetermined time and then at a second speed for a predetermined time, the detector 100 detects a real torque component current value ($i_q$) for driving the motor at the first speed and detects a real torque component current value ($i_q$) for driving the motor at the second speed.

In addition, the detector 100 detects an estimated speed of the motor through a speed control apparatus of the motor when the mode of the washing machine is converted into a dewatering mode. For example, after the motor of the washing machine is driven sequentially at the first speed and at the second speed, the detector 100 detects a real torque component current ($i_q$) for driving the motor at the first speed (e.g., 70 rpm) and detects a real torque component current ($i_q$) for driving the motor at the second speed (e.g., 100 rpm). Here, the first speed (e.g., 70 rpm) and the second speed (e.g., 100 rpm) are desired speeds for measuring the laundry weight and the amount of eccentricity, preset by experiments and may be changed variously (S1).

Thereafter, the detector 100 outputs a real torque component current ($i_q$) for driving the motor at the first speed and a real torque component current ($i_q$) for driving the motor at the second speed to a first low pas filter 101 having a high cut-off frequency and a second low pass filter 102 having a low cut-off frequency. For example, the detector 100 outputs the real torque component current ($i_q$) for driving the motor at the first speed to the first low pass filter 101 having a high cut-off frequency and the second low pass filter 102 having a low cut-off frequency. In addition, the detector 100 outputs the real torque component current ($i_q$) for driving the motor at the second speed to the first low pass filter 101 having a high cut-off frequency and the second low pass filter 102 having a low cut-off frequency.

The first low pass filter 101 filters the rear torque component current ($i_q$) for driving the motor at the first speed and the rear torque component current ($i_q$) for driving the motor at the second speed and outputs a filtered first real torque component current (first current). At this time, the second pass filter 102 filters the rear torque component current ($i_q$) for driving the motor at the first speed and the rear torque component current ($i_q$) for driving the motor at the second speed and outputs a filtered second rear torque component current (second current) to the controller 104. Here, a ripple speed of the first and second speeds is preferably removed through a filter such as a low pass filter.

The controller 104 detects a value of the first real torque current having passed through the first low pass filter 101 and detects a value of the second real torque component current having passed through the second low pass filter 102 (S2). Here, a value of the first real torque component current is a current value obtained by passing the current for driving the motor at the first speed through the first low pass filter 101 and a current value obtained by passing the current for driving the motor at the second speed through the first low pass filter 101. In addition, the value of the second real torque component current is a current value obtained by passing the current for driving the motor at the first speed through the second low pass filter 101 and a current value obtained by passing the current for driving the motor at the second speed through the second low pass filter 101. The current value has a maximum value and a minimum value as shown in FIGS. 8A to 8D.

Thereafter, a comparer (not shown) of the controller 104 compares an estimated speed of the motor with the first speed and the second speed. At this time, if the estimated speed of the motor is lower than the first speed and the second speed, the controller 104 does not perform the step of measuring a laundry weight and a compensation value of the amount of eccentricity but measures the estimated speed of the motor again, preferably.

If the estimated speed of the motor is higher than the first speed and the second speed (S3), the controller 104 calculates an electric rotation angle of the motor (S4) and compares the calculated rotation angle with a preset reference angle (A1) to determine whether the calculated rotation angle is greater than the preset reference angle (A1) (S5). Here, the electrical rotation angle of the motor is calculated because an unnecessary value may be obtained if current amplitudes are calculated based on the rear torque component current values having passed through the first low pass filter 101 and the second low pass filter 102 and a laundry weight value and a compensation value of the amount of eccentricity are successively calculated in calculating said values by using the current amplitudes. Accordingly, in order to remove the unnecessary value and calculate the laundry weight value and the compensation value of the amount of eccentricity at regular intervals, preferably, the reference rotation angle (A1) is preset, and the laundry weight value and the compensation value of the amount of eccentricity are calculated according to the preset reference rotation angle (A1).

If the rotation angle is smaller than the preset reference rotation angle, the controller 104 calculates a maximum value and a minimum value of an eccentricity current to be used to calculate a compensation value of the amount of eccentricity based on the sum total of the first current and the second current and stores the calculated values in the storage 103. For example, the controller 104 calculates a first eccentricity current value by adding a current value of a first speed having passed through the first low pass filter 101 to a current value of the first speed having passed through the second low pass filter 102; and calculates a second eccentricity current value by adding a current value of a second speed having passed through the first low pass filter 101 to a current value of the second speed having passed through the second low pass filter 102. Then, the controller 104 adds the first eccentricity current value to the second eccentricity current value and calculates a maximum value and a minimum value of a value obtained by said adding.

In addition, if the rotation angle is smaller than the preset reference rotation angle, the controller 104 calculates a maximum value and a minimum value of a laundry weight current to be used to calculate a laundry weight value prior to compensation of the amount of eccentricity on the basis of the first current and stores the calculated maximum value and the minimum value of the laundry weight current in the storage 103 (S6). For example, the controller 104 adds a current value of a first speed having passed through the first low pass filter 101 to a current value of a second speed having passed through the second low pass filter 102 and calculates a maximum value and a minimum value of the value obtained by said adding. Here, if the rotation angle is greater than the preset reference rotation angle, the controller 104 initializes the rotation angle of the motor (S7).

For example, in the method for detecting a maximum value and a minimum value of the current, if a rotation angle of the motor is smaller than the preset reference rotation angle, a maximum value and a minimum value of an eccentricity current are calculated on the basis of the first current and the second current, and a maximum value and a minimum value of the laundry weight current are calculated on the basis of the first current until the rotation angle becomes greater than the preset reference rotation angle.

Thereafter, if the rotation angle is greater than the preset reference rotation angle, the laundry weight detector 105 calculates an amplitude of each current on the basis of the stored maximum and minimum values of the eccentricity current and the stored maximum and minimum values of the laundry weight current. For example, if the rotation angle is greater than the reference rotation angle, the laundry weight detector 105 calculates a first current amplitude to be used to calculate a compensation value of the amount of eccentricity on the basis of the maximum and minimum values of the eccentricity current stored when the rotation angle is smaller than the reference rotation angle and also calculates a second current amplitude to be used to calculate a laundry weight value on the basis of the maximum value and minimum values of the laundry weight current stored when the rotation angle is smaller than the reference rotation angle (S8).

The laundry weight detector 105 converts the calculated first current amplitude and the calculated second current amplitude into a compensation value of the amount of eccentricity and a laundry weight value prior to compensation of the amount of eccentricity, respectively. For example, the laundry weight detector 105 detects a compensation value of the amount of eccentricity, which corresponds to the first current amplitude, from compensation values of the amount of eccentricity, pre-stored in the storage 103. In addition, the laundry weight detector 105 detects a laundry weight value corresponding to the second current amplitude from laundry weight values pre-stored in the storage 103. Here, the pre-stored compensation values of the amount of eccentricity and the laundry weight values are predetermined through experiments (S9).

Thereafter, the laundry weight detector 105 detects a final laundry weight on the basis of the detected laundry weight value and the detected compensation value of the amount of eccentricity. For example, the laundry weight detector 105 subtracts the detected compensation value of the amount of eccentricity from the detected laundry weight value and determines a value obtained by said subtracting as a final laundry weight value. Here, the final laundry weight value means a laundry weight value of wet laundry. The final laundry weight according to the wet laundry is calculated through the following Equation 4 (S10).

Final laundry weight value=(a first laundry weight value prior to compensation of the amount of eccentricity when a speed of the motor is the first speed+a second laundry weight value prior to compensation of the amount of eccentricity when a speed of the motor is the second speed)−(a first compensation value of the amount of eccentricity when the speed of the motor is the first speed+a second compensation value of the amount of eccentricity when the speed of the motor is the second speed) Equation 4

Accordingly, through the steps (S1~S9) of the present invention, a first laundry weight value and a first compensation value of the amount of eccentricity are detected when the speed of the motor is the first speed, and a second laundry weight value and a second compensation value of the amount of eccentricity are detected when the speed of the motor is the second speed.

In order to correctly detect the final laundry weight value, the laundry weight detector 105 may calculate a final laundry weight of the wet laundry through the following Equation 5.

Final laundry weight value=(a first laundry weight value prior to compensation of the amount of eccentricity when the speed of the motor is the first speed×$M1$+a second laundry weight value prior to compensation of the amount of eccentricity when the speed of the motor is the second speed×$M2$)−(a first compensation value of the amount of eccentricity when the speed of the motor is the first speed+a second compensation value of the amount of eccentricity when the speed of the motor is the second speed)×$M3$ Equation 5

Here, said M1-M3 are scale values arbitrarily preset in order to determine a final laundry weight. That is, said M1-M3 are constant values predetermined to classify final laundry weights by various levels. For example, a fact that a laundry weight can be easily classified by setting a preset constant value (M1) so that the influence of a first laundry weight is small in case of the first speed, setting a constant value (M2) so that the influence of a second laundry weight is great in case of the second speed, and setting a constant value (M3) so that the influence of the amount of eccentricity is the same in both cases of the first speed and the second speed was found out through several trials and errors.

Accordingly, in the present invention, after the motor is driven at the first speed and then at the second speed, a final laundry weight value according to a weight of wet laundry can be correctly measured based on real torque component current values needed to drive the motor at the first and second speeds.

Figure 6:
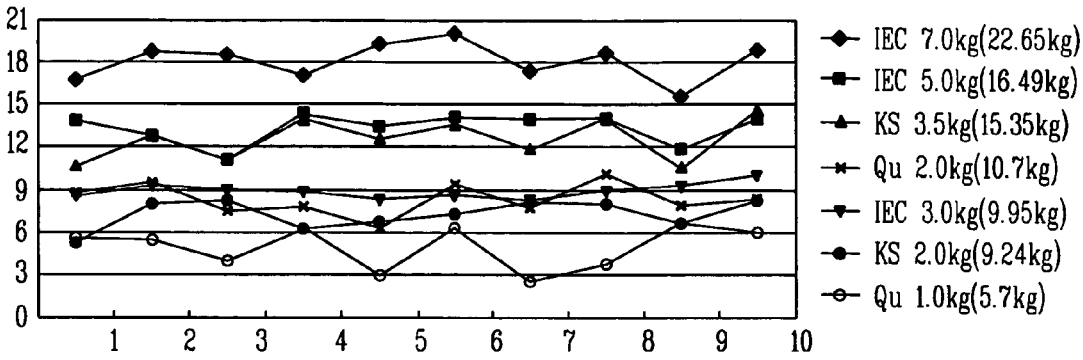
FIG. 6 is a view showing laundry weight values according to wet laundry.
Figure 8A:
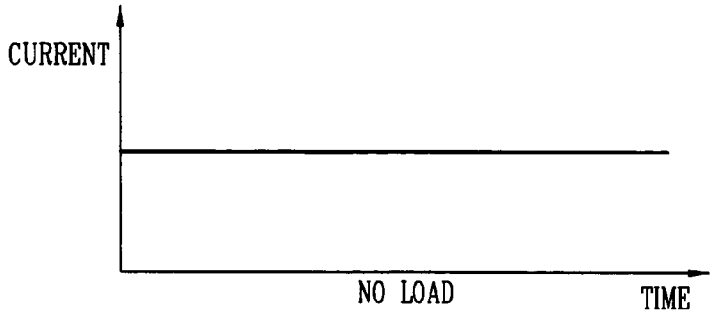
FIGS. 8A-8D are views showing a waveform of each real torque component current according to changes of the amount of eccentricity of a washing machine.
Figure 8B:
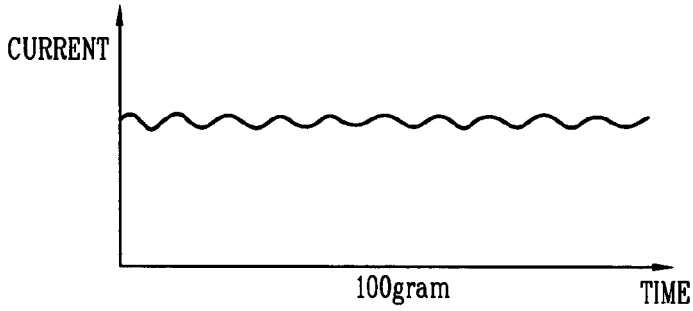
Figure 8C:
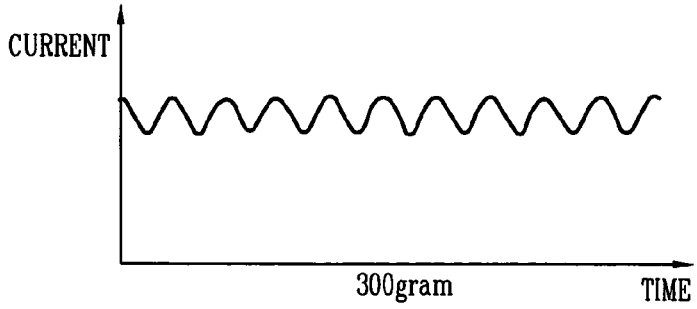
Figure 8D:
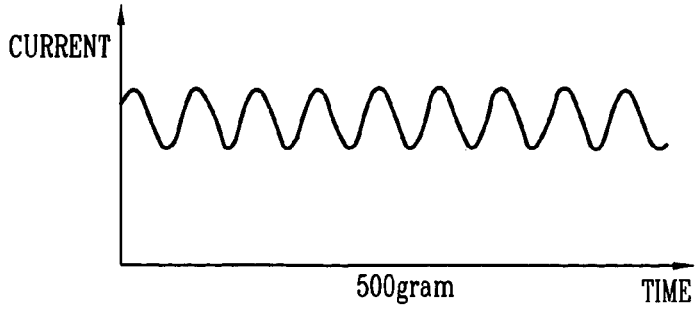

FIG. 6 is a view showing laundry weight values according to wet laundry. That is, FIG. 6 is a view showing laundry weight values detected through the method for detecting the laundry weight in accordance with the present invention and showing laundry weight values of wet laundry in a washing machine in accordance with IECS (International Electrotechnical Commission standards), KS (Korean Industrial Standards), Quelle standards (Qu). Here, the laundry weight values may be varied according to the kind and the weight of the wet laundry in the washing machine.

FIG. 7 is a view for comparing a weight of dry weight with that of wet laundry.

As shown therein, because specific gravity of a weight in case of dry laundry to a weight in case of wet laundry is varied according to IECS, KS or Qu, a weight of dry laundry is different from its weight when it is wet. For example, it can be known that, even though IEC-3.5 kg is heavier than KS-3.0 kg by 0.5 kg when laundry is dry, it is measured that KS-3.0 kg is heavier than IEC-3.5 kg by about 1.5 kg when the laundry is wet.

FIGS. 8A-8D are views showing a waveform of a real torque component current according to a change of the amount of eccentricity of a drum of a washing machine.

As shown therein, an amplitude (maximum value and minimum value of current) of a real torque component current applied to the motor of the washing machine is increased as the amount of eccentricity (e.g., 100 g, 300 g, 500 g, or the like) is increased.

In the present invention, a laundry weight of a washing machine can be detected through various methods based on a value of a first current for driving the motor at the first speed and a value of a second current for driving the motor at the second speed after the motor of the washing machine is driven at the first speed and then the motor is driven at the second speed, without the first low pass filter 101 and the second low pass filter 102.

As so far described, in the present invention, a laundry weight of the washing machine can be detected correctly based on current amplitudes needed to drive the motor at the first speed and at the second speed after the motor is driven sequentially at the first speed and then at the second speed.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A method for detecting a laundry weight of a washing machine comprising:

converting a mode of a washing machine into a dewatering mode, driving a motor of the washing machine sequentially at a first speed and at a second speed for a preset time and detecting a first current for driving the motor at the first speed and a second current for driving the motor at the second speed;

outputting a first current by filtering each detected current through a first low pass filter;

outputting a second current by filtering each detected current through a second low pass filter, wherein the first current is a first speed current value obtained by passing a current for driving the motor at the first speed through the first low pass filter and a second speed current value obtained by passing a current for driving the motor at the second speed through the first low pass filter;

calculating a maximum value and a minimum value of an eccentricity current to be used to calculate a compensation value of an amount of eccentricity of the drum of the washing machine on the basis of values of the first current and the second current;

calculating a maximum value and a minimum value of a laundry weight current to be used to calculate a laundry weight value prior to compensation of the amount of the eccentricity on the basis of the first current;

calculating a first current amplitude on the basis of a maximum value and a minimum value of the eccentricity current and calculating a second current amplitude on the basis of a maximum value and a minimum value of the laundry weight current; and detecting a final laundry weight on the basis of a predetermined compensation value of the amount of eccentricity, which corresponds to the first current amplitude and a predetermined laundry weight value corresponding to the second current amplitude.

2. The method of claim 1, wherein the second current is a third speed current value obtained by passing a current for driving the motor at the first speed through the second low pass filter and a fourth speed current value obtained by passing a current for driving the motor at the second speed through the second low pass filter, the second low pass filter having a cut-off frequency lower than the cut-off frequency of the first low pass filter.

3. The method of claim 1, wherein, in calculating a laundry weight current, the first speed current value is added to the second speed current value, and a maximum value and a minimum value of a current value obtained by said adding are calculated.

4. The method of claim 2, wherein, in calculating the eccentricity current, a first eccentricity current value is calculated by adding the first speed current value to the third speed current value, a second eccentricity current value is calculated by adding the second speed current value to the fourth speed current value, the first eccentricity current value are added to the second eccentricity current value, and a value obtained by said adding are calculated.

5. The method of claim 1, wherein, in determining a final laundry weight, the predetermined compensation value of the amount of eccentricity is subtracted from the predetermined laundry weight value, and a value obtained by said subtracting is determined as the final laundry weight.

6. The method of claim 1, the first low pass filter having a cut-off frequency higher than a cut-off frequency of the second low pass filter.

7. The method of claim 1, the second low pass filter having a cut-off frequency lower than a cut-off frequency of the first low pass filter.

8. The method of claim 1, wherein calculating a maximum value and a minimum value of the eccentricity current and a maximum value and a minimum value of the laundry weight current, further comprises:

calculating a rotation angle if an estimated speed of the motor is higher than the first speed or the second speed, wherein the second speed is higher than the first speed; and calculating a maximum value and a minimum value of the eccentricity current and a maximum value and a minimum value of the laundry weight current if the calculated rotation angle is smaller than a preset reference angle.

9. The method of claim 1, wherein the final laundry weight is a laundry weight according to a weight of wet laundry.

10. The method of claim 1, wherein the final laundry weight is calculated by equation of "(a first laundry weight value prior to compensation of the amount of eccentricity when the speed of the motor is the first speed ×M1 + a second laundry weight value prior to compensation of the amount of eccentricity when the speed of the motor is the second speed ×M2)−(a first compensation value of the amount of eccentricity when the speed of the motor is the first speed + a second compensation value of the amount of eccentricity when the speed of the motor is the second speed) ×M3", wherein said M1~M3 are scale values preset to determine the final laundry weight.

11. A method for detecting a laundry weight of a washing machine comprising:

converting a mode of a washing machine into a dewatering mode, driving a motor of the washing machine sequentially at a first speed and at a second speed for a preset time and then detecting a current for driving the motor at the first speed and a current for driving the motor at the second speed, respectively;

outputting a first current by filtering each detected current through a first low pass filter;

outputting a second current by filtering each detected current through a second low pass filter, wherein the first current is a first speed current value obtained by passing a current for driving the motor at the first speed through the first low pass filter and a second speed current value obtained by passing a current for driving the motor at the second speed through the first low pass filter;

calculating a maximum value and a minimum value of an eccentricity current to be used to calculate a compensation value of the amount of eccentricity of the drum of the washing machine on the basis of values of the first current and the second current;

calculating a maximum value and a minimum value of a laundry weight current to be used to calculate a laundry weight value prior to compensation of the amount of the eccentricity on the basis of the first current;

calculating a first current amplitude on the basis of a maximum value and a minimum value of the eccentricity current and calculating a second current amplitude on the basis of a maximum value and a minimum value of the laundry weight current;

detecting a final laundry weight on the basis of a predetermined compensation value of the amount of eccentricity, which corresponds to the first current amplitude and a predetermined laundry weight value corresponding to the second current amplitude; and not measuring the laundry weight value and the compensation value of the amount of eccentricity if a detected speed of the motor is lower than the first speed and the second speed but measuring the detected speed of the motor again by initializing a rotation angle of the motor.

* * * * *